US005134948A

United States Patent [19]

Suzuta et al.

[11] Patent Number: 5,134,948

[45] Date of Patent: Aug. 4, 1992

[54] OVERLOCKING SEWING MACHINE AND METHOD FOR PERFORMING OVERLOCK SEWING IN OVERLOCKING SEWING MACHINE

[75] Inventors: Mamoru Suzuta; Youichi Nishi, both of Nagoya; Kenji Umemura, Anjo; Hirobumi Kubo, Nagoya, all of Japan

[73] Assignee: Brother Kogyo Kabushiki Kaisha, Japan

[21] Appl. No.: 570,789

[22] Filed: Aug. 22, 1990

[30] Foreign Application Priority Data

Sep. 11, 1989 [JP] Japan ..... 1-235382

[51] Int. Cl.[5] ..... D05B 1/20; D05B 65/00

[52] U.S. Cl. ..... 112/162; 112/269.1; 112/199; 112/288

[58] Field of Search ..... 112/162, 165, 197, 286, 112/288, 199, 269.1

[56] References Cited

U.S. PATENT DOCUMENTS 4,480,562 11/1984 von Hagen et al. ..... 112/165 X 4,984,526 1/1991 Ide et al. ..... 112/162

FOREIGN PATENT DOCUMENTS 2058858 4/1981 United Kingdom ..... 112/286

*Primary Examiner*—Peter Nerbun

*Attorney, Agent, or Firm*—Oliff & Berridge

[57] ABSTRACT

An overlock sewing machine having a loop spreading member which provides a retracted position and an operative position. In the retracted position, the loop spreading member is moved away from one side of needle hole slots, which one side being positioned farther from an edgeline of a workpiece. In the operative position the loop spreading member is engageable with a chain and the chain is insertable over the outer tongue upon shifting of the chain portion located at its needle side toward a workpiece feed-in side. The sewing machine further includes drive means connected to the loop spreading member for moving the loop spreading member from its retracted position to the operative position prior to a shifting operation of the chain toward the workpiece feed-in side with respect to positions of the needles.

8 Claims, 2 Drawing Sheets

OVERLOCKING SEWING MACHINE AND METHOD FOR PERFORMING OVERLOCK SEWING IN OVERLOCKING SEWING MACHINE

BACKGROUND OF THE INVENTION

The present invention relates to an overlock sewing machine capable of performing a back-tack stitching. The present invention also relates to a method for performing an overlock sewing in the overlocking sewing machine.

In a conventional overlocking sewing machine, needle threads are inserted into a pair of needles, and looper threads are inserted into an overlooper and an underlooper. In cooperation with the needles and loopers, the looper threads are wound over stitch formation tongues positioned adjacent to a needle hole slot of a throat plate so as to provide an overlock stitch pattern stitched with four threads and two needles on a workpiece fabric. Upon completion of the sewing operation, a thread chain provided by the needles and the workpiece is cut, and then the thread chain is stretchedly positioned to a workpiece feed-in side while extending beyond over the needle positions, and a free end of the thread chain is held in a predetermined position. While maintaining this chain position, the thread chain is subjected to stitching to the workpiece for performing the back-tack stitching.

In the conventional sewing machine, when the thread chain is shifted to the workpiece feed-in side with respect to the needles, the chain end portion positioned at the needle side is located in a vicinity of an end portion of the needle hole slot of the throat plate. Therefore, if the new stitching is started in such a state, the needle passes through the thread chain end portion located at the needle side after the new thread chain is formed on the stitch formation tongues while the workpiece is fed to the needle location. As a result, a newly formed thread chain does not undergo stitching, and accordingly, the unstitched thread chain may entangledly be protruded in a spherical shape from the workpiece edge. Alternatively, an already formed thread chain is not sufficiently stitched, so that the unstitched part may bulge from the overlocking stitching pattern. Consequently, stitching quality may be degraded.

SUMMARY OF THE INVENTION

It is therefore an object of the present invention to overcome the aforesaid drawbacks and disadvantages, and to provide an improved overlock sewing machine in which penetration of a needle into a thread chain can be eliminated at a starting phase of a back-tack stitching, and the thread chain can surely be stitched into the overlock stitch pattern, to thereby provide an excellent overlock stitching.

These and other objects of the invention will be attained in accordance with the present invention by providing an overlock sewing machine including at least one needle reciprocally movable in a vertical direction and bearing at least one needle thread, a throat plate formed with at least one needle hole slot for allowing the needle to pass therethrough, at least one looper bearing at least one looper thread and movable in synchronism with the movement of the needle, and at least one stitch formation tongue provided at a position adjacent the slot, the looper thread being wound over the tongue in cooperation with the needle and the tongue for forming an overlock stitching pattern on a workpiece which has an edgeline, and the improvement comprising a loop spreading member selectively movable between a retracted position where the loop spreading member is moved away from one side of the needle hole slot, that one side being positioned further from the edgeline of the work-piece, and an operative position where the loop spreading member is engageable with a chain and the chain is insertable over the tongue upon shifting of the chain portion located at its needle side toward a workpiece feed-in side, and drive means connected to the loop spreading member for moving the loop spreading member from its retracted position to the operative position prior to a shifting operation of the chain toward the workpiece feed-in side with respect to positions of the needle.

In another aspect of the invention, there is provided an overlock sewing machine including needles reciprocally movable in a vertical direction and bearing needle threads, a throat plate formed with needle hole slots for allowing the needles to pass therethrough, loopers bearing looper threads and movable in synchronism with the movements of the needles, and stitch formation tongues provided at positions adjacent the slots, the looper thread being wound over the tongues in cooperation with the needles and the tongues for forming an overlock stitching pattern on a workpiece which has an edgeline, and the improvement comprising a loop spreading member selectively movable between a retracted position where the loop spreading member is moved away from one side of the needle hole slots, which one side being positioned further from the edgeline of the work-piece, and an operative position where the loop spreading member is engageable with a chain and the chain is insertable over one of the tongues upon shifting of the chain portion located at its needle side toward a workpiece feed-in side, drive means connected to the loop spreading member for moving the loop spreading member from its retracted position to the operative position prior to a shifting operation of the chain toward the workpiece feed-in side with respect to positions of the needles, and holding means for holding the thread chain at the workpiece feed-in side with respect to the position of the needles.

In still another aspect of the invention, there is provided a method for performing an overlock sewing to a workpiece in an overlock sewing machine provided with at least one sewing needle and at least one stitch formation tongue for forming a thread chain, the method comprising the steps of disengaging the thread chain part positioned at the needle side from the stitch formation tongue, enlarging a thread loop positioned at the thread chain part, moving the thread chain to a workpiece feed-in side for bringing the thread loop into engagement with the stitch formation tongue, and holding the thread chain at the workpiece feed-in side.

When the loop spreading member is positioned at its retracted position where it is spaced away from the needle hole slot, the overlock stitching is formed on the workpiece in concurrent winding of the looper thread over the stitch formation tongue positioned adjacent the needle hole slot in coopertion with the needles and the looper. At the terminal phase of the stitching, the loop spreading member is moved to its operative position by the drive means before the chain succeeding the workpiece and the needle is moved to the workpiece feed-in side with respect to the needle. In accordance with the movement of the loop spreading member to the operative position, the thread chain portion located at the needle side is displaced to a position at which the chain can be engaged with the tongue. With maintaining this chain position, if the chain is moved to the workpiece feed-in side, the chain portion located at the needle side is inserted over the tongue. If a new workpiece is to be stitched while maintaining this chain engagement state with the tongue, the chain can be stitched along the edgeline of the workpiece.

DETAILED DESCRIPTION OF THE PREFERRED EMBODIMENT

Figure 1:
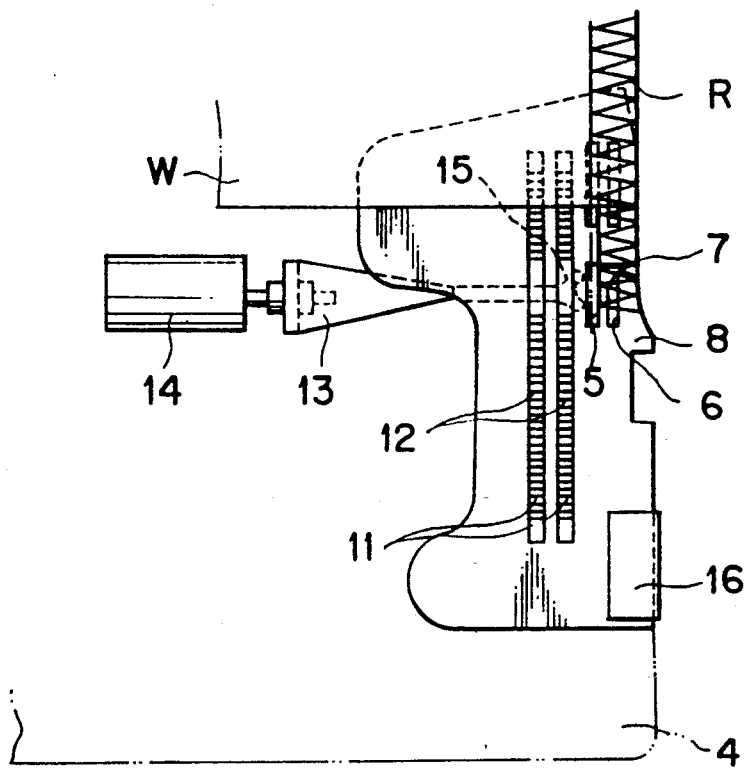
FIG. 1 is a plan view showing an essential part of an overlock sewing machine according to one embodiment of the present invention.

An overlock sewing machine according to one embodiment of this invention will be described with reference to FIGS. 2 through 5.

A throat plate 1 is positioned on a workpiece supporting surface 4 (FIG. 2), and is formed with a pair of needle hole slots 5, 6, positioned in confrontation with a pair of needles 2, 3 for allowing the latter to pass therethrough. These slots 5 and 6 are defined by inner and outer stitch formation tongues 7 and 8. That is, the first tongue 7 is positioned between the two needle hole slots 5 and 6, and the second tongue 8 is positioned adjacent to the needle hole slot 6 nearer the edge of a workpiece W.

An underlooper 9 is provided at a position below the throat plate 1 and is pivotally movable in synchronism with vertical reciprocating motions of the needles 2 and 3. Further, an overlooper 10 is provided which is protrudable over the throat plate 1. Needle threads Y1 and Y2 are to be passed through eyes of the needles 2 and 3, respectively, and looper threads Y3 and Y4 are to be passed through eyes of the loopers 9 and 10. In accordance with the cooperation of the needles 2 and 3 and loopers 9 and 10, overlock stitch pattern consisting of four threads is formed at the workpiece edge while the looper threads Y3 and Y4 are wound over the stitch formation tongues 7 and 8. At the terminal phase of the stitching, thread chains R are formed at a position between the end portion of the workpiece W and the needles 2 and 3.

Figure 3:
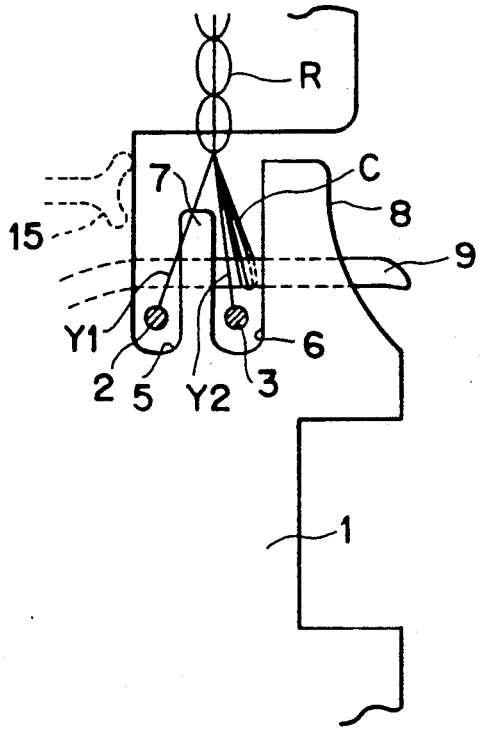
FIGS. 3 through 5 are enlarged plan views showing the essential part for description of formation of a thread chain.
Figure 4:
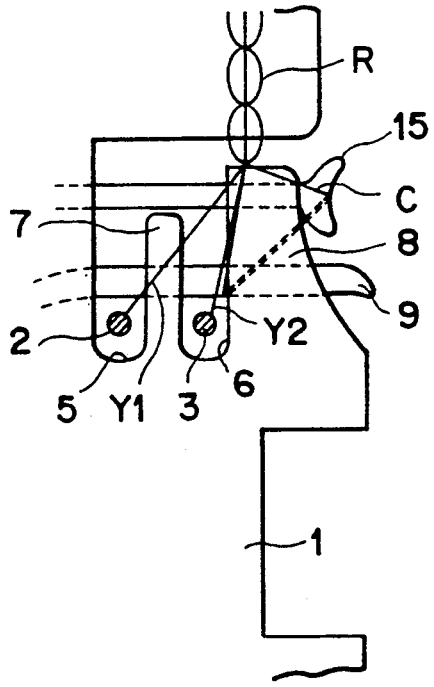

The throat plate 1 is formed with a plurality of openings 12 through which feed dogs 11 movable toward and away from the workpiece supporting surface 4 are disposed for imparting feed movement to the workpiece W. Further, a loop spreading member 13 is disposed below the throat plate 1. The loop spreading member 13 is reciprocally movable in a direction perpendicular to the feeding direction of the workpiece W in such a manner that mechanical interference between the feed dogs 11 and the member 13 is eliminatable. The spreading member 13 has a base end portion coupled to a drive means such as a pneumatic cylinder 14, and has a free end provided with an engageable portion 15. The engageable portion 15 is adapted to be engageable with a thread loop C (FIG. 3) which is provided by the needle threads Y1 and Y2 at a needle side position, the thread loop C being formed successively from the thread chains R which have been engaged with the underlooper 9 as shown in FIG. 3. The engageable portion 15 is also adapted for enlarging a diameter of the loop C at a position corresponding to the second tongue 8 as shown in FIG. 4. Further, at a workpiece feed-in side with respect to the needles 2 and 3, a holding member 16 is provided on the throat plate 1 for holding the free end side of the thread chain R.

When the pneumatic cylinder 14 is at deenergized state, the loop spreading member 13 has its retracted position where the engageable member 15 is positioned inwardly with respect to the first needle hole slot 5, that is, the engageable member 15 of the loop spreading member 13 is positioned leftwardly relative to the slot 5 as shown in FIG. 1. On the other hand, when the pneumatic cylinder 14 is at its actuated state, the loop spreading member 13 has its operative position where its engageable member 15 moves across the two slots 5 and 6 for enlarging the diameter of the thread loop C, i.e., the engageable member 15 is moved rightwardly as shown in FIG. 4.

Figure 2:
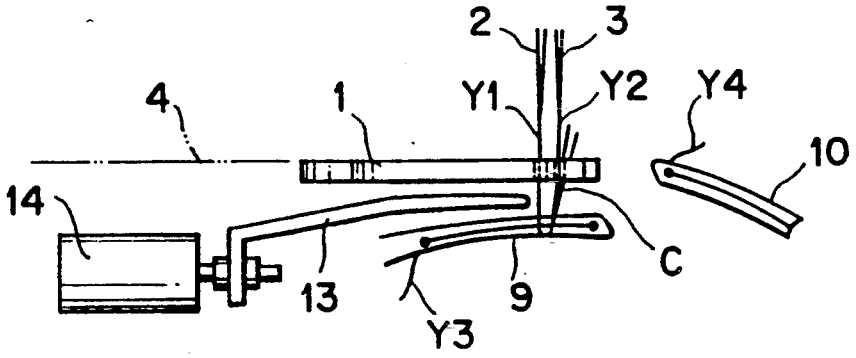
FIG. 2 is a schematic front elevational view showing the essential part of the sewing machine according to the embodiment.

In operation, the workpiece W is fed by the actuation of the feed dogs 11, and in the meanwhile, the overlock stitch pattern is formed at the workpiece edge by the cooperation of the needles 2 and 3 and the loopers 9 and 10. During this stitching operation, the pneumatic cylinder 14 is held in deenergized state, so that the loop spreading member 13 is positioned at its retracted position as shown in FIG. 2. In this case, the loop spreading member 13 does not interfere with the feed dogs 11.

After termination of the sewing operation with respect to the edgeline of the workpiece W, thread chain R is provided which is succeeding the workpiece W and the needles 2 and 3. After formation of such thread chain, the needles 2 and 3 are stopped at their upper needle positions as shown in FIG. 2, and at the same time, the underlooper 9 is stopped in such a manner that it enters into the thread loop C given by the needle threads Y1 and Y2. Prior to manual shifting of the thread chain R to the workpiece feed-in side with respect to the needle location, the thread chain portion R located at the needle side is disengaged from the stitch formation tongues 7 and 8 as shown in FIG. 3.

While maintaining this thread releasing position from the tongues, when the pneumatic cylinder 14 is actuated, the loop spreading member 13 is moved from its retracted position (FIG. 3) to its operative position (FIG. 4), so that the engageable portion 15 is brought into engagement with the thread loop C, and the loop C is enlarged at a position in confrontation with the tip end portion of the external tongue 8 as shown in FIG. 4.

Figure 5:
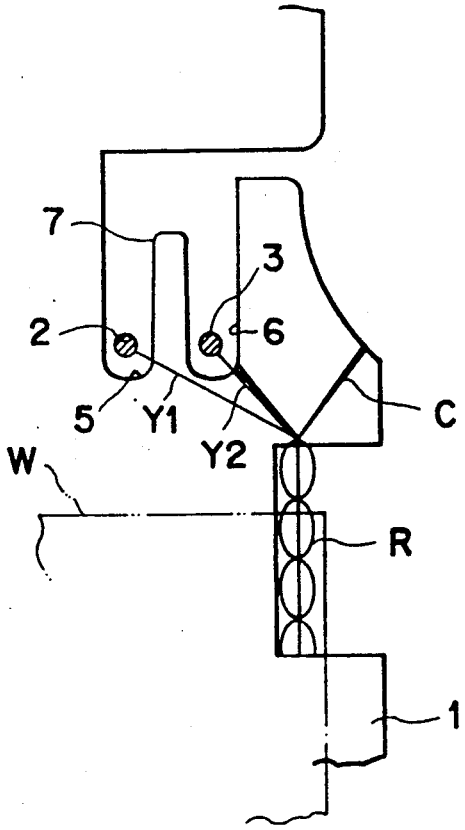

Subsequently, when the thread chain R together with the workpiece W are manually displaced to the workpiece feed-in side with respect to the needle location as shown in FIG. 5, the thread loop C is surroundingly disposed over the second tongue 8, so that the loop C is positioned away from the needle hole slots 5 and 6, i.e., the loop is moved rightwardly relative to these slots in FIG. 5. Then, the thread chain R is cut from the workpiece, and the cut leading end portion of the thread chain is retained on the workpiece supporting surface 4 by the holding member 16. As a result, entire thread chain R can be positioned along an extension line extending from the external tongue 8 and along the edgeline of the throat plate 1.

Next, a new workpiece W is positioned on the workpiece supporting surface 4 for starting a subsequent sewing operation. In accordance with the feed movement of the workpiece W, the thread chain R is subjected to stitching with the chain stretched at the edgeline of the workpiece. In this case, since the entire chain R is located on the extension line of the external tongue 8, each of the needles 2 and 3 does not pass through the thread chain R. Accordingly, incidental looping at the edgeline of the workpiece can be avoided, and meandering stitching of the chain R is eliminated. Consequently, the thread chain R can surely be stitched in the overlock stitch pattern, to thus provide excellent stitching quality.

Incidentally, the above described drive means such as the pneumatic cylinder can be replaced by an electromagnetic solenoid. Further, the overlock sewing machine of the present invention can be used in combination with an automatic thread cutting unit which automatically cuts, at the end timing of the sewing operation, the thread chain succeeding the needles and the workpiece.

According to the present invention, as described above, the needles do not pass through the thread chain at a starting phase of the back-tack stitching. Therefore, the chain can be stitched without fail into the overlock stitch pattern for providing high quality stitching.

While the invention has been described in detail and with reference to specific embodiment thereof, it would be apparent to those skilled in the art that various changes and modifications may be made therein without departing from the spirit and scope of the invention.

What is claimed is:

1. An overlock sewing machine including:

at least one needle reciprocally movable in a vertical direction and bearing at least one needle thread, a throat plate formed with at least one needle hole slot for allowing the needle to pass therethrough, the throat plate having a side edge, at least one looper bearing at least one looper thread and movable in synchronism with the movement of said at least one needle, and at least one stitch formation tongue provided at a position adjacent the slot and the side edge of the throat plate remote from a needle location, the looper thread being wound over the at least one stitch formation tongue in cooperation with the needle and the looper for forming an overlock stitching pattern on a workpiece which has a side edgeline, the at least one stitch formation tongue being positioned adjacent the side edgeline, a free thread chain being provided upon completion of stitching, the free thread chain extending from a trailing edge of the workpiece position on a workpiece feed-out side of the needle location and reaching the sewing needle, and the improvement comprising:

a loop spreading member selectively movable between a retracted position where the loop spreading member is positioned away from one side of said at least one needle hole slot, the one side being positioned away from the edgeline of the workpiece, and an operative position where the loop spreading member is movable toward another side of the at least one needle hole slot and toward the edgeline of the workpiece and is engageable with a part of a thread loop of the thread chain to enlarge an opening defined by the thread loop, the enlarged thread loop being surroundingly disposed over said at least one stitch formation tongue upon shifting of a thread chain portion located at the workpiece feed-out side toward a workpiece feed-in side; and drive means connected to the loop spreading member for moving the loop spreading member from the retracted position to the operative position prior to a shifting operation of the chain toward the workpiece feed-in side.

2. An overlock sewing machine including:

two needles reciprocally movable in a vertical direction and bearing needle threads a throat plate formed with inner and outer needle hole slots extending side by side for allowing the needles to pass therethrough, loopers bearing looper threads and movable in synchronism with the movements of the needles, and inner and outer stitch formation tongues provided at positions adjacent the slots, the looper thread being wound over the tongues in cooperation with the needles and the loopers for forming an overlock stitching pattern on a workpiece which has a side edgeline, the outer stitch formation tongue being positioned adjacent the side edgeline of the workpiece, a free thread chain being provided upon completion of stitching, the free thread chain extending from a trailing edge of the workpiece positioned on a workpiece feed-out side with respect to the two needles and reaching the sewing needles, and the improvement comprising:

a loop spreading member selectively movable between a retracted position where the loop spreading member is positioned away from the inner needle hole slot, wherein the retracted loop spreading member is positioned farther from the outer slot than the inner slot, and an operative position where the loop spreading member is movable toward the outer needle hole slot and engageable with a part of a thread loop of a thread chain to enlarge an opening defined by the thread loop, the enlarged thread loop being surroundingly disposed over the outer tongue upon shifting of the chain portion located at the workpiece feed-out side toward a workpiece feed-in side;

drive means connected to the loop spreading member for moving the loop spreading member from the retracted position to the operative position prior to a shifting operation of the chain toward the workpiece feed-in side; and holding means for holding the thread chain at the workpiece feed-in side, the holding means being positioned along an extension of the outer tongue, wherein the free thread chain is located between the outer tongue and the holding means and along the extension.

3. The overlock sewing machine as claimed in claim 2, wherein the loop spreading member comprises a base portion coupled to the drive means and a free end portion provided with an engageable portion engageable with the loop which has been wound over one of the loopers for separating the loop from said one of the loopers and for engaging the loop with the outer tongue.

4. A method for performing an overlock sewing to a workpiece in an overlock sewing machine provided with two sewing needles and an inner and an outer stitch formation tongue for forming a thread chain, a free and unstitched thread chain being provided between a trailing edge of a workpiece and the sewing needles, the method comprising the steps of:

disengaging from the stitch formation tongues a thread chain part engaged with the tongues;

enlarging an opening defined by a thread loop positioned at the thread chain part;

moving the thread chain to a workpiece feed-in side for bringing the thread loop into engagement with the outer stitch formation tongue, the thread loop being surroundingly disposed over and engaged with the outer tongue, such that the outer tongue is inserted into the opening of the enlarged loop; and holding the thread chain at the workpiece feed-in side and at a position along an extension of the outer tongue which is positioned away from the two sewing needles for avoiding entanglement of the thread chain with a new thread chain produced in a new stitch.

5. A thread chain guiding and restraining device of an overlock sewing machine, for a free thread chain extending from a stitched workpiece and having at least one needle thread and at least one looper thread and forming at least one thread loop, the guiding and restraining device comprising:

a throat plate having an outer tongue provided on an outermost side of an outermost needle;

a loop spreading member having a first position at an innermost side of an innermost needle and disengaged from said at least one thread loop, and a second position at the outermost side of the outermost needle and engaged with said at least one thread loop wherein said at least one thread loop is enlarged and disposed around the outer tongue;

a drive means for moving the loop spreading member between the first and second positions when the stitched workpiece is in a feed-out position; and a holding means for avoiding entanglement of the free thread chain when performing a new stitch, by restraining the free thread chain after severance from the stitched workpiece in a feed-in position, wherein the outer tongue and the holding means act together to guide and restrain the thread chain after the workpiece is moved from the feed-out position to the feed-in position about the outermost side of the outermost needle and the free thread chain is severed from the workpiece.

6. The thread chain guide and restraining device of claim 5, wherein the sewing machine comprises:

the throat plate having an inner and an outer needle slot and an inner tongue provided between them;

the innermost needle having a first needle thread and movable in a vertical direction within the first needle slot;

the outermost needle having a second needle thread and movable in a vertical direction within the second needle slot;

loopers having looper threads and synchronously movable with movements of the needles, the looper threads being wound over the tongues in cooperation with the needle threads for forming an overlock stitching pattern on the workpiece.

7. The thread chain guide and restraining device of claim 5, wherein the free thread chain is provided upon completion of stitching of the workpiece, the free chain extending beyond a trailing edge of the workpiece positioned on a workpiece feed-out side of the sewing machine and extending to the needles of the sewing machine.

8. A thread chain guiding and restraining device of an overlock sewing machine, for a free thread chain extending from a stitched workpiece and having at least one needle thread and at least one looper thread and forming at least one thread loop, the guiding and restraining device comprising:

a throat plate having an outer tongue provided on an outer side of a needle;

a loop spreading member having a first position at an inner side of the needle and disengaged from said at least one thread loop, and a second positon at the outer side of the needle and engaged with said at least one thread loop wherein the thread loop is enlarged and disposed around the outer tongue;

a drive means for moving the loop spreading member between the first and second positions when the stitched workpiece is in a feed-out position; and a holding means for avoiding entanglement of the free thread chain when performing a new stitch, by restraining the free thread chain after severance from the stitched workpiece in a feed-in position, wherein the outer tongue and the holding means act together to guide and restrain the thread chain after the workpiece is moved from the feed-out position to the feed-in position about the outer side of the needle and the free thread chain is severed from the workpiece.

* * * * *